United States Patent [19]

Kircher

[11] 3,970,041

[45] July 20, 1976

[54] APPARATUS FOR DEPOSITING FIBROUS DIAPHRAGMS

[75] Inventor: Morton S. Kircher, Oakville, Canada

[73] Assignee: Olin Corporation, New Haven, Conn.

[22] Filed: Apr. 2, 1975

[21] Appl. No.: 564,967

[52] U.S. Cl. ..... 118/428; 211/41

[51] Int. Cl.[2] ..... B05C 3/02

[58] Field of Search ..... 118/428, 429, 503, 425, 118/500; 211/40, 41; 354/340–346; 204/252, 279, 297 W

[56] References Cited

UNITED STATES PATENTS

| | | | |
|---|---|---|---|
| 127,580 | 6/1872 | Davies | 118/428 X |
| 1,729,316 | 9/1929 | Williams | 211/41 |
| 1,853,888 | 4/1932 | Williams | 211/41 |
| 2,936,270 | 5/1960 | Webster et al. | 204/297 W |
| 3,733,523 | 5/1973 | Reynolds et al. | 211/41 X |

FOREIGN PATENTS OR APPLICATIONS

| | | | |
|---|---|---|---|
| 5,211 | 9/1910 | United Kingdom | 118/500 |

*Primary Examiner*—Morris Kaplan
*Attorney, Agent, or Firm*—James B. Haglind; Donald F. Clements; Thomas P. O'Day

[57] ABSTRACT

An apparatus for depositing a fibrous diaphragm on electrodes having foraminous surfaces which includes a tank having a bottom and side walls. A dividing means, such as a rack, having a plurality of frames, each having a top edge, and side edges, is positioned in the tank. The rack may be attached along one of the side edges of the frames to one of the side walls of the tank or it may be secured to support members positioned on the bottom of the tank. The frames of the rack are spaced apart from each other by a distance related to the spacing between electrodes. The frames may have cross members joining the side edges and have rollers on the top edge and the cross members.

The apparatus is suitably used in depositing a fibrous diaphragm on electrodes having a large surface area and narrow spacing between adjacent electrodes. The apparatus prevents bridging of the fiber between electrodes and also prevents adjacent electrodes from being drawn together during the application of a vacuum to deposit the diaphragm.

11 Claims, 4 Drawing Figures

APPARATUS FOR DEPOSITING FIBROUS DIAPHRAGMS

This invention relates to electrolytic diaphragm cells for the electrolysis of aqueous solutions of alkali metal halides. More particularly, the invention relates to the depositing of diaphragms on foraminous electrodes.

It is known in the prior art to deposit a diaphragm on electrodes, usually the cathodes, having foraminous surfaces by submerging the electrodes in a tank containing a slurry of asbestos fibers in a liquid medium. A vacuum is applied to the electrodes and the asbestos is deposited on the electrodes. The electrodes used in the prior art were of limited size and surface area and the spacing between adjacent electrodes was relatively large. In addition, cathodes were constructed with steel structural members designed for strength and rigidity. Such structures for comparable rigidity but of increased size would be heavy, expensive and time consuming to fabricate.

At present, it is possible to employ foraminous electrodes in a diaphragm cell having increased size and therefore surface area while employing reduced spacing between adjacent electrodes. Further, the electrodes can be of reduced thickness and therefore reduced weight.

In depositing a diaphragm on these large electrodes having reduced spacing between electrodes using the methods of the prior art, as exemplified by U.S. Pat. No. 1,865,152, issued to Stuart, asbestos bridging across the electrode spacing occurs as well as the drawing together of adjacent electrodes. Both of these phenomena interfere with the deposition of a diaphragm having a uniform thickness over the entire electrode surfaces to be coated.

Now it has been found that a diaphragm having a controlled uniform thickness can be deposited over the entire electrode by employing apparatus for depositing a fibrous diaphragm on a plurality of electrodes having foraminous surfaces comprising a tank having a bottom and walls and having dividing means for separating the electrodes from each other removably secured to one of the walls the means comprising pluralities of rod elements; each plurality of rods lying in a substantially vertical plane spaced from another such plane; and roller means disposed on the rod elements whereby the dividing means functions to maintain the electrodes, when immersed spaced apart and to inhibit abrasion thereon.

FIG. 1 shows a front view of one embodiment of the apparatus of the present invention in a tank having the front wall removed.

FIG. 2 depicts a front view of another embodiment of the apparatus of the present invention in a tank having the front wall removed.

FIG. 3 illustrates the front view of an additional embodiment of the apparatus of the present invention in a tank having the front wall removed.

FIG. 4 is a side view of a tank having portions cut away employing the apparatus of FIG. 3 with electrodes partially inserted.

Figure 1:
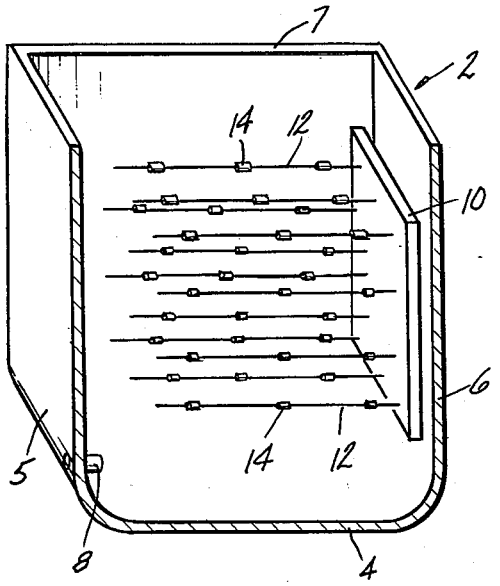
FIGS. 1–4 illustrate various embodiments of the novel apparatus of this invention. Corresponding parts have the same identifying numbers in FIGS. 1–4.

Tank 2, in FIG. 1, has bottom 4 and walls 5, 6, 7, and 9 and is open at the top. Inlet 8 permits the introduction of a slurry of fibrous material to be deposited as a diaphragm. Plate 10 is secured to wall 6. A plurality of rods 12 are attached to plate 10 and project from plate 10 towards wall 5. Rods 12 are spaced apart horizontally along plate 10 so that rods 12 separate adjacent electrodes (not shown) during deposition of the fibrous diaphragm. Rollers 14 mounted on rods 12, aid in the formation of a uniform diaphragm layer on the electrodes.

Figure 2:
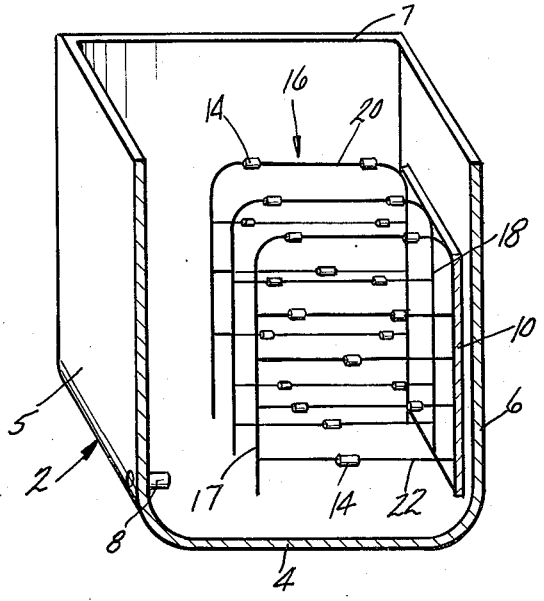

FIG. 2 shows frames 16 having sides 17 and 18 and top edge 20. Sides 18 are attached to plate 10 secured to wall 6. Cross members 22 are attached to sides 17 and 18 and provide support for frames 16. Rollers 14 are mounted on top edges 20 and cross members 22.

Figure 3:
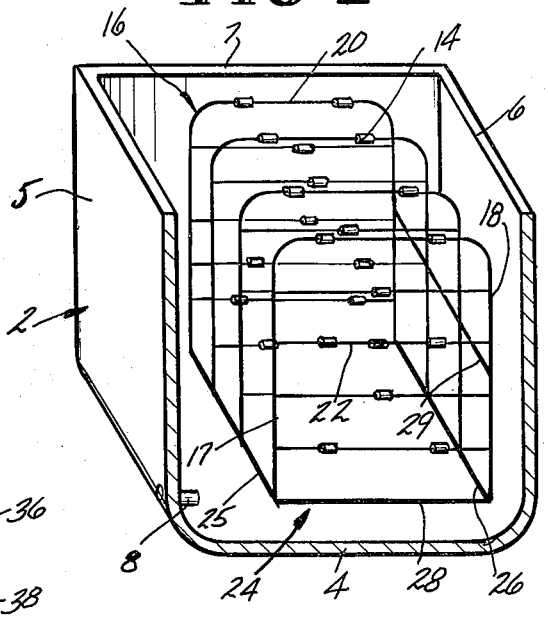

Rack 24, illustrated in FIG. 3, has support members 25 and 26 positioned on bottom 4 of tank 2. Support members 25 and 26 are substantially parallel to each other. Frames 16, having sides 17 and 18, top edge 20 and bottom edge 28, are attached to support members 25 and 26 along portions of sides 17 and 18 and bottom edge 28.

Frames 16 are spaced apart a predetermined distance to separate adjacent electrodes while the fibrous diaphragm is being deposited.

Stabilizing bar 29 is attached along sides 18 of frames 16 above and parallel to support member 26.

Figure 4:
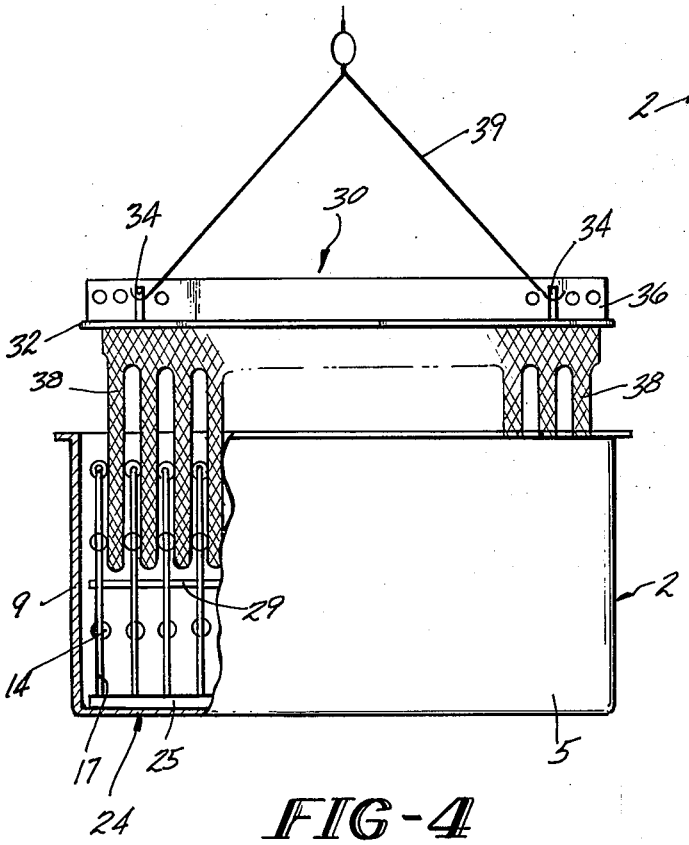

FIG. 4 shows a cathode section 30 comprised of cathode plate 32 having lugs 34, conductor 36 and a plurality of foraminous cathodes 38 attached. Cathode section 30 is suspended above tank 2 by cable 39 secured to lugs 34. Foraminous cathodes 38 are partially inserted between frames 16 of rack 24. Sides 17 of frames 16 are attached to support member 25. Rollers 14 on top edges 20 and cross members 22 contact the surfaces of foraminous cathodes 38 to help distribute the fibrous material uniformly over the cathode surfaces while preventing top edges 20 and cross members 22 from abrading the diaphragm being deposited.

The novel apparatus of the present invention is used in depositing fibrous diaphragms onto foraminous electrode surfaces in a tank having dividing means for insertion between adjacent electrodes. Any suitable dividing means may be used, for example, rods, plates, frames, etc. The dividing means may be attached directly to the wall or to a support means secured to the wall. The dividing means are spaced apart along the length of the wall a distance which is determined by the spacing between adjacent electrodes on which a fibrous diaphragm is to be deposited. The dividing means are suitably spaced apart from about 0.75 to about 1.50, and preferably from about 1.00 to about 1.25 inches. The attachment means for the dividing means is therefore preferably adjustable, for example, having grooves or slots permitting changing of the spacing between adjacent dividers along the horizontal.

Where rods are employed as the dividing means, as illustrated in FIG. 1, several rods may be alligned vertically to prevent adjacent electrode surfaces from being drawn together when a vacuum is applied. Any convenient vertical spacing may be used between adjacent rods.

In employing frames as dividing means, as illustrated in FIGS. 2 and 3, the substantially vertically disposed removable frames may be attached to a wall of the tank or employed in the form of a rack. The frames have two side edges and a top edge and, if desired, may have a bottom edge. To provide additional support, cross members including a plurality of rods may be used which are attached to the two sides.

Support members are employed where the frames are arranged in the form of a portable rack positioned on the bottom of the tank. The sides and/or bottom edge of the frames are attached to the support member by any suitable means such as clamps, wires, welds and the like. It is preferred to have the spacing between adjacent frames adjustable and therefore that the support members have notches, slots or the like or means to permit the frames to be movably attached. The support members are positioned substantially parallel on the tank bottom.

Stabilizing means may be employed along one side of the frames, if desired, to provide mechanical support for the frames. Any suitable means such as a bar, rod or the like may be attached along one side of the frames.

Roller means may be mounted on the dividing means to aid in the formation of a diaphragm of uniform thickness being deposited on the electrode surfaces. The rollers also prevent the dividing means from abrading the surface of the diaphragm by centering the dividing means between adjacent electrodes surfaces.

The novel apparatus of the present invention is used in depositing a diaphragm of a fibrous material such as asbestos on the surfaces of foraminous electrodes, usually cathodes. It is particularly suitable for use with electrodes of an electrolytic diaphragm cell for the electrolysis of aqueous alkali metal chloride solutions as described in U.S. Patent 3,898,149, issued Aug. 5, 1975 to M. S. Kircher and E. N. Macken. The cell employs a plurality of electrodes of from about 2 to about 12 and preferably from about 3 to about 8 feet in height and from about 2 to about 6 and preferably from about 3 to about 5 feet in length. The electrodes are attached to electrode plates which are positioned vertically in the cell. Cathodes are comprised of a conductive element surrounded by a conductive screen or mesh. The conductive element may be in the form of a plate or rod having attachment means for the screen or mesh. The conductive screen is any metal which is conductive and resistant to the cell environment for example steel or nickel screen. The anodes are in the form of, for example, perforated plates, expanded metal or screen which is composed of a valve metal such as titanium or tantalum. The valve metal has a thin coating over at least part of its surface of a platinum group metal or a platinum group metal compound such as an oxide or a mixture thereof.

The distance between adjacent electrode surfaces for electrodes having the same polarity, for example, between adjacent cathode surfaces, is from about 0.75 to about 1.50 and preferably from about 1.00 to about 1.25 inches.

In depositing a diaphragm on an electrode, usually the cathode, a slurry of the fibrous material to be deposited is prepared in a mixing tank by adding the fibrous material, for example fibers of asbestos, polypropylene, polyethylene or polytetrafluoroethylene, to an aqueous solution containing about 10 percent by weight of sodium hydroxide and 15 percent by weight of sodium chloride. The mixture is agitated, for example, by the introduction of air and pumped to a deposition tank.

The electrode section, normally the cathode section, is suspended above the deposition tank by means of a hoist or crane and lowered until the cathodes are inserted between the dividing means, spaced apart a distance corresponding to that of the cathodes, and the cathode surface is immersed in the fibrous slurry to a predetermined depth. A vacuum is applied to the cathode section, for example by attaching one end of a hose to an opening in the cathode plate and the other to a vacuum mixing tank which is in turn evacuated by a vacuum pump. The fibers are deposited on the portion of the cathode in contact with the slurry for a preselected time period with the solution being returned to the vacuum mixing tank. The cathodes are lowered a preselected distance and the amount of vacuum increased and fibers deposited for a predetermined time period. This procedure is repeated until a diaphragm of the desired thickness has been deposited on the cathodes. During the deposition, the fibrous slurry may be agitated, for example, by vertical movement of the cathodes. Contact with the dividing means spreads the fiber slurry more uniformly, prevents the formation of fibrous bridges between adjacent cathode surfaces and prevents the drawing together of adjacent cathode surfaces. Where roller means are employed with the dividing means, they space the dividing means between adjacent cathode surfaces and thus aid in smoothing out and distributing the fibrous material over the cathode surface. The cathode section is removed from the deposition tank and the deposited diaphragm dried before assembling the cathode section in the electrolytic cell.

The apparatus of the present invention permits a diaphragm to be uniformly deposited on foraminous electrodes which have a large surface area to be covered while having narrow spacing between adjacent electrodes. The apparatus prevents the formation of fibrous bridges between adjacent electrode surfaces. The bridges block the flow of fibrous material to areas adjacent to the bridges. Physical contact with the dividing means breaks the bridges and permits the diaphragm to be uniformly deposited. Similarly, the apparatus permits the use of electrodes constructed of light weight members which have a high degree of flexibility, while preventing the adjacent electrode surfaces being drawn together when applying a vacuum during the diaphragm deposition process.

What is claimed is:

1. Apparatus for depositing a fibrous diaphram on a plurality of electrodes having foraminous surfaces comprising a tank for holding a slurry of fibrous material having a bottom and walls and having dividing means for separating said electrodes from each other and removably secured to one of said walls, said means comprising pluralities of rod elements; each plurality of rods lying in a substantially vertical plane spaced from another such plane; and roller means disposed on said rod elements whereby said dividing means functions to maintain said electrodes, when immersed, spaced apart and to inhibit abrasion thereon.

2. The apparatus of claim 1 wherein said pluralities of rods are secured in positions substantially perpendicular to said side wall, said rods being spaced apart a distance of from about 0.75 to about 1.50 inches from each other.

3. The apparatus of claim 1 wherein each said plurality of rods is included in a frame having a top edge and side edges, one of said side edges being secured to one of said side walls of said tank.

4. The apparatus of claim 3 wherein cross members are attached to and join said side edges of said frames.

5. The apparatus of claim 4 wherein roller means are attached to said top edge of said frames.

6. The apparatus of claim 5 wherein said frames are spaced apart equally a distance of from about 0.75 to about 1.50 inches from one another.

7. Apparatus used in depositing a fibrous diaphragm on a plurality of electrodes having foraminous surfaces, said apparatus being positioned in a tank for holding a slurry of fibrous material, said tank having a bottom and side walls, which comprises:

a. a plurality of substantially vertically disposed removable frames, each frame having a top edge and including a plurality of rods supported between said side edges and roller means supported on at least certain of said rods and side edges, b. a pair of support members positioned on said bottom of said tank, said support members being substantially parallel and spaced apart, said frames being attached to said support members along a portion of said side edges and said frames being spaced apart from one another.

8. The apparatus of claim 7 wherein cross members are attached to and join said side edges of said frames.

9. The apparatus of claim 7 wherein roller means are attached to said top edge of said frames.

10. The apparatus of claim 9 wherein said frames are spaced apart equally a distance of from about 0.75 to about 1.50 inches from one another.

11. The apparatus of claim 10 wherein a stabilizing bar is attached along one side of said frames above and parallel to one of said support members.

* * * * *

PO-1050
(5/69)

UNITED STATES PATENT OFFICE
CERTIFICATE OF CORRECTION

Patent No. 3,970,041 Dated July 20, 1976

Inventor(s) Morton S. Kircher

It is certified that error appears in the above-identified patent and that said Letters Patent are hereby corrected as shown below:

Claim 7, at column 5, line 9, after "edge" insert --and side edges--.

Signed and Sealed this

Nineteenth Day of October 1976

[SEAL]

*Attest:*

RUTH C. MASON
*Attesting Officer*

C. MARSHALL DANN
*Commissioner of Patents and Trademarks*